United States Patent [19]

Connolly et al.

[11] 4,230,605

[45] Oct. 28, 1980

[54] CLEANING COMPOSITION FOR NO-WAX VINYL COMPOSITION FLOOR COVERING

[75] Inventors: Arlene D. Connolly, Elizabethtown; James M. Eshleman, Manheim; Edgar W. Knaub, Willow Street, all of Pa.

[73] Assignee: Armstrong Cork Company, Lancaster, Pa.

[21] Appl. No.: 969,252

[22] Filed: Dec. 13, 1978

[51] Int. Cl.[2] ..... C11D 3/43; C11D 3/37

[52] U.S. Cl. ..... 252/545; 252/153; 252/548; 252/174.24; 106/3; 106/8

[58] Field of Search ..... 252/548, 545, DIG.2, 252/DIG. 3, 89 R, 153, 174.24; 106/3, 8; 260/29.6 TA, 29.6 Z

[56] References Cited

U.S. PATENT DOCUMENTS

| | | | |
|---|---|---|---|
| 3,467,610 | 9/1969 | Fiarman et al. | 260/29.6 TA X |
| 3,574,124 | 4/1971 | Lyness et al. | 252/153 |
| 3,669,892 | 6/1972 | Abler et al. | 106/3 X |
| 3,741,914 | 6/1973 | Parks | 252/545 |
| 3,856,711 | 12/1974 | Mausner et al. | 252/548 X |
| 4,002,571 | 1/1977 | Anderle et al. | 252/DIG. 2 X |
| 4,013,607 | 3/1977 | Dwyer et al. | 260/29.6 TA X |
| 4,017,662 | 4/1977 | Gehman et al. | 428/443 |
| 4,070,510 | 1/1978 | Kahn | 106/8 X |
| 4,077,896 | 3/1978 | Bunegar et al. | 252/548 X |

*Primary Examiner*—Harris A. Pitlick

[57] ABSTRACT

The high gloss of vinyl composition floor coverings having a no-wax coating is maintained by using a cleaner consisting essentially of an aqueous emulsion polymerized alkali-soluble terpolymer having an average molecular weight of about 23,000, the terpolymer being an addition polymer based on about 51% by weight methyl methacrylate, 31% by weight butyl acrylate, and 18% by weight acrylic acid; a mixture of 50% by weight of the reaction product of 1 mole of coconut oil to 2 moles diethanolamine and 50% by weight of the reaction product of 1 mole dodecylbenzenesulfonic acid to 1 mole diethanolamine; an organic solvent; an aqueous ammonia solution; and water. Before being used as a cleaner the cleaner is preferably diluted to between about 0.5 to 0.10 percent solids.

3 Claims, No Drawings

CLEANING COMPOSITION FOR NO-WAX VINYL COMPOSITION FLOOR COVERING

BACKGROUND OF THE INVENTION

1. Field of the Invention

The Field of the Invention generally relates to cleaning solutions applicable for use with vinyl composition floor coverings, such as tile and sheet goods, and, more specifically, relates to a cleaner for use with high gloss, no-wax coatings.

2. Description of the Prior Art

In recent years there has been developed in the resilient flooring industry high performance, high gloss coatings which are designed to give the consumer a resilient flooring product which does not require the conventional wax treatments heretofore commonly associated with resilient flooring products of a vinyl composition. Generally speaking, all that has been required for ordinary maintenance is an occasional cleaning to remove dirt to maintain the high gloss. However, with these new high performance, high gloss coatings, it has been found that when conventional cleaners are utilized, unless particular attention is given to properly rinsing the floor after cleaning, ordinary cleaners can leave a dulling film on floors that can actually trap dirt and make the floor look dull, dirty, and worn out after a relatively short time. An object of this invention is to provide a novel cleaner which leaves no dulling film and which maintains the high gloss without rinsing.

SUMMARY OF THE INVENTION

It has now been found that a cleaner composition for use in maintaining the high gloss of a vinyl composition floor covering having a high performance, no-wax coating may be formulated from an aqueous mixture consisting essentially of an aqueous emulsion polymerized alkali-soluble terpolymer having an average molecular weight of about 23,000, the terpolymer being an addition polymer based on about 51% by weight methyl methacrylate, 31% by weight butyl acrylate, and 18% by weight acrylic acid together with a surfactant, which is a mixture of 50% by weight of the reaction product of 1 mole of coconut oil to 2 moles diethanolamine and 50% by weight of the reaction product of 1 mole dodecylbenzenesulfonic acid to 1 mole diethanolamine. Small amounts of solvent are added together with sufficient aqueous ammonia to solubilize the acrylic emulsion polymer. This formulation, when used as a cleaner to restore the high gloss of the high performance, no-wax coating, is simply diluted with water and applied to the floor to remove the dirt and then, without rinsing, dried to yield a film which does not interfere with the high gloss and which has little or no residual effect for trapping dirt particles.

DETAILED DESCRIPTION

Conventional vinyl composition resilient floors generally require considerable upkeep to maintain a high gloss, clean surface. Such surfaces have been obtained through the use of conventional polish formulations based on wax and/or resin systems which either dry to yield a film having a high gloss or which, in turn, are buffed to develop high gloss. When such floor products show signs of wear and dirt, the polish compositions are ordinarily stripped with conventional cleaners and the floor then thoroughly rinsed and repolished.

To overcome the maintenance properties associated with conventional vinyl composition resilient floor coverings, the industry has in recent years introduced high gloss, high performance, no-wax coatings which do not require the use of polish compositions, but which only require normal maintenance including periodic cleaning. It has been found, however, that many of the conventional cleaners in the marketplace tend to deposit dull, sometimes greasy, dirt-trapping residues if not completely removed by careful rinsing. These residues tend to trap dirt in traffic areas, and traffic on the soiled surface can make the floor look dull, dirty, and worn out even after a relatively short time.

We have discovered a unique combination of ingredients which, when used in a floor cleaner, results in a floor cleaner that does not require rinsing to give both good appearance and performance to the high gloss, high performance, no-wax products. The cleaner consists essentially of an aqueous emulsion polymerized alkali-soluble terpolymer having an average molecular weight of about 23,000, the terpolymer being an addition polymer based on about 51% by weight methyl methacrylate, 31% by weight butyl acrylate, and 18% by weight acrylic acid together with a surfactant, which is a mixture of 50% by weight of the reaction product of 1 mole of coconut oil to 2 moles diethanolamine and 50% by weight of the reaction product of 1 mole dodecylbenzenesulfonic acid to 1 mole diethanolamine. Preferably, the ratio of the acrylic emulsion polymer to surfactant is 80:20 parts by weight in the cleaner composition, although the desired performance in maintaining gloss and appearance may be achieved at ratios between about 85:15 to 75:25 parts by weight polymer to surfactant.

A solvent is also incorporated into the cleaner composition, and we have found that the solvent preferably utilized is ethylene glycol monobutylether. Its primary function is as a cleaning aid, although it also apparently aids the coalescence of the formula. It is present in the diluted cleaner formulation in from about 0.1 to 1.0 part by weight per 100 parts by weight water.

Ammonia is a necessary component of the cleaner composition, and its primary function is to solubilize the acrylic emulsion polymer, although it also contributes to the cleaning ability of the cleaner. Sufficient ammonia (a 28% aqueous ammonia is conveniently utilized) is added to adjust the pH of the cleaner composition to a minimum of about 8.3 and preferably an optimum pH of approximately 10. Conventional minor ingredients are added such as organic antifoams, dyes for aesthetic purposes, and odorants if desired. Water is added to establish a total solids concentration of approximately 7.1%. Before application the solids level is reduced by adding water to give a percent by weight solids of from about 0.10 to 0.5.

The following example illustrates a floor cleaner composition of this invention.

| Ingredients | Parts by Weight | Parts by Weight Solids |
|---|---|---|
| Soft Water | 71.68 | |
| Acrylic Emulsion Terpolymer(1) | 14.69 | 5.65 |
| Surfactant(2) | 1.42 | 1.42 |
| Ethylene Glycol Monobutylether | 7.95 | |
| Aqua Ammonia (28%) | 4.20 | |
| Dimethyl Silicone Antifoam(3) | .008 | |
| Odorant Lime Bouquet | .050 | |
| Dye-Solantine Turquoise | .001 | |

-continued

| Ingredients | Parts by Weight | Parts by Weight Solids |
|---|---|---|
| Dye-Naphthanol Yellow | .0005 | |

(1)Rohm & Haas Emulsion Polymers E-1250 - An aqueous emulsion acrylic terpolymer containing about 51% by weight methyl methacrylate polymerized units, 31% by weight butyl acrylate polymerized units, and 18% by weight acrylic acid polymerized units. 38.5% by weight solids. Average molecular weight of 23,000.
(2)Monamine ALX 100S - A mixture of 50% by weight of the reaction product of 1 mol coconut oil and 2 mols diethanolamine and 50% by weight of the reaction product of 1 mol dodecylbenzene sulfonic acid and 1 mol diethanolamine.
(3)SWS-211 - Straight chain dimethyl silicone manufactured by SWS Silicones Corporation.

In formulating the cleaner, the water, acrylic emulsion terpolymer, surfactant, and ammonia are first thoroughly mixed, after which the ethylene glycol monobutylether, antifoam, odorant, and coloring ingredients are added. The mixing is done at room temperature. The resultant cleaner is a clear, transparent, green-colored solution. The pH is about 10.1.

In preparing the cleaner for use, it is diluted with water using between about ¼ cup to about 1 cup per gallon. This results in a final percent solids of between about 0.1 and 0.5.

To determine the degree of dulling produced by not rinsing vinyl composition floor coverings having a no-wax coating cleaned with ordinary floor cleaners and the floor cleaner of this invention, a gloss study was conducted. Solutions of commercial floor cleaners and the floor cleaner of this invention were applied to samples of Armstrong Cork Company unembossed Designer Solarian and allowed to dry. The gloss of each sample was then measured and compared to a control. This was repeated three times to determine how the residual accumulations further changed the gloss.

The following floor-cleaner solutions were prepared in accordance with the manufacturers directions and daubed onto the surface of 4"×4" samples of new, unembossed Designer Solarian using a Kimwipe.

Cleaner prepared in accordance with the above example—1 cup/gal water
Spruce-Up (Armstrong Cork Co.)—1 cup/gal water
Top Job (Proctor and Gamble)—1 cup/gal water
Top Job (Proctor and Gamble)—¼ cup/gal water
Ivory Liquid (Proctor and Gamble)—1 cup/gal water
New Beginning (Armstrong Cork Co.)—Not diluted
Tap water The samples were allowed to air dry after which five gloss measurements were made on each sample using the Gardner Multi-Angle Glossmeter set for 60° gloss. An untreated control sample was measured at the same time. This procedure was repeated two additional times. The mean gloss values for each group of five measurements are reported in the following table. Experimental error at high gloss level is approximately 1½ units and becomes larger with residue buildup since residue distribution can be uneven.

TABLE I

Effect of Floor-Cleaner Residues on the 60° Gloss of Unembossed Designer Solarian

| Floor Cleaner | Number of Cleaner Applications 0 | 1 | 2 | 3 |
|---|---|---|---|---|
| Control | 54 | 53 | 55 | 54 |
| NRC-88 (1 cup/gal) | 54 | 54 | 57 | 57 |
| Tap Water | 54 | 47 | 52 | 50 |
| Spruce-Up (1 cup/gal) | 54 | 38 | 40 | 32 |
| Top Job (1 cup/gal) | 54 | 21 | 26 | 25 |
| Top Job (¼ cup/gal) | 54 | 26 | 39 | 34 |
| Ivory Liquid (1 cup/gal) | 54 | 29 | 29 | 23 |

TABLE I-continued

Effect of Floor-Cleaner Residues on the 60° Gloss of Unembossed Designer Solarian

| Floor Cleaner | Number of Cleaner Applications 0 | 1 | 2 | 3 |
|---|---|---|---|---|
| New Beginning (not diluted) | 54 | 26 | 26 | 22 |

To study the resistance-to-resoiling property of the no-rinse cleaner of this invention, a traffic test was conducted using Solarian samples that had been treated with various floor cleaner solutions. All of the samples were treated four times prior to the test in order to generate a significant concentration of residue. A traffic procedure was then used to uniformly apply soil to the samples and simulate traffic conditions.

Solutions of the following floor cleaners were prepared according to label directions.

Cleaner prepared in accordance with the above example—1 cup/gal water
Ajax Liquid (Colgate-Palmolive)—¼ cup/gal water
Top Job—¼ cup/gal water
Ivory Liquid (I)—¼ cup/gal water
Spruce-Up—1 cup/gal water
New Beginning—Not diluted
Tap Water The samples, after testing, were all visually ranked. Samples treated with New Beginning, Spruce-Up, Ivory Liquid, and Top Job all exhibited severe dirt trapping in the embossed areas. The samples treated with the cleaner of this invention, tap water, and Ajax Liquid exhibited very little dirt pickup by comparison. The untreated controls showed only slightly less dirt pickup than the samples treated with the cleaner of this invention, tap water, and Ajax; however, there was no noticeable difference in gloss between the untreated controls and the samples treated with the cleaner of this invention. All of the samples treated with conventional cleaners exhibited a dulling residue which noticeably reduced the shiny appearance of the Solarian. In summary, the samples treated with the cleaner of this invention exhibited better resistance to soiling than most of the conventional floor cleaners tested and no apparent reduction in gloss when compared to the control.

We claim:

1. A method of maintaining the high gloss of a vinyl composition floor covering having a no-wax coating comprising using as a cleaner a water diluted solution prepared from an aqueous cleaner consisting essentially of:

(a) an aqueous emulsion acrylic terpolymer containing about 51% by weight methyl methacrylate polymerized units, 31% by weight butyl acrylate polymerized units, and 18% by weight acrylic acid polymerized units;

(b) a mixture of 50% by weight of the reaction product of 1 mol coconut oil and 2 mols diethanolamine and 50% by weight of the reaction product of 1 mol dodecylbenzene sulfonic acid and 1 mol diethanolamine;

the ratio of solids being 85 to 75 parts (a) to 15 to 25 parts (b);

ethylene glycol monobutylether;

sufficient aqueous ammonia to provide a pH of greater than about 8.3;

and water;

said cleaner being diluted before use to give a solution having between about 0.1 to 0.5% by weight solids and 0.1 to 1.0 part by weight ethylene monobutyl ether per 100 parts water.

2. The method of claim 1 in which the cleaner before dilution has a pH of about 10.

3. The method of claim 1 or 2 in which the ratio of solids is 80 parts (a) to 20 parts (b).

* * * * *